US008808465B1

(12) United States Patent
Darnall

(10) Patent No.: US 8,808,465 B1
(45) Date of Patent: Aug. 19, 2014

(54) EXTEND RAZOR BLADE EFFECTIVE-LIFE BY A FACTOR OF 5 TO 7 TIMES

(71) Applicant: James Ronald Darnall, Austin, TX (US)

(72) Inventor: James Ronald Darnall, Austin, TX (US)

( * ) Notice: Subject to any disclaimer, the term of this patent is extended or adjusted under 35 U.S.C. 154(b) by 0 days.

(21) Appl. No.: 13/862,448

(22) Filed: Jun. 6, 2013

(51) Int. Cl.
*C23G 1/02* (2006.01)

(52) U.S. Cl.
USPC ..... 134/41; 134/26; 134/28; 134/32

(58) Field of Classification Search
USPC ..... 134/2, 3, 26, 28, 32, 34, 40, 41
See application file for complete search history.

(56) References Cited

U.S. PATENT DOCUMENTS

| | | | | |
|---|---|---|---|---|
| 5,879,469 | A * | 3/1999 | Avram | 134/25.2 |
| 2005/0277562 | A1 * | 12/2005 | Xia et al. | 510/161 |
| 2009/0013534 | A1 * | 1/2009 | Mallaridas | 30/41 |

* cited by examiner

*Primary Examiner* — Michael Kornakov
*Assistant Examiner* — Ryan Coleman

(57) ABSTRACT

This disclosure dramatically extends by a factor of 5 to 7, the effective service-life of steel shaving blades by chelating mineral molecules in common tap water, thus preventing them from accumulating and attaching to the blade surfaces.

1 Claim, No Drawings

EXTEND RAZOR BLADE EFFECTIVE-LIFE BY A FACTOR OF 5 TO 7 TIMES

This invention provides a method to extend the number of shaves by high quality shaving blades by a factor of at five (5) to seven (7). That is, if a blade's useful life is 7 shaves, then this method will extend the blade's life more than 35 shaves.

BACKGROUND OF THE INVENTION

Today, as in days past, major complaints about shaving razors are their short life and high cost. For example, a $2 blade from Gillette lasts about 7 shaves unless it is subjected to cryogenic processes, then the cost doubles but it lasts about 28 shaves. There are three primary causes that influence shaving blade-life:

Blade quality

Cutting resistance

Mineral crystal molecules from water

Mineral molecules coalesce to form sharp crystals that attach themselves to the blade. This is the major contributor to reduced blade life. These crystal buildups are extremely sharp and contribute to what is commonly known as "razor burn" which causes blades to be discarded.

Since Gillette invented the safety razor, there have been many patented improvements. Some include:

1. U.S. Pat. No. 4,201,599 Morgans May 6, 1980
   While addressing mineral buildup on blade cutting edges, this process involves chlorhexidine with harmful, possibly deadly side effects.
2. U.S. Pat. No. 8,313,693 Winsell Nov. 20, 2012
   A shaving razor maintenance system but it does not address mineral buildup.
3. U.S. Pat. No. 7,143,517 Kappes, et al. Dec. 5, 2006
   This idea addresses only electric shaving heads with ultra-sound.
4. U.S. Pat. No. 7,858,027 Razor protection system
   Another razor blade maintenance system; however it does not address mineral buildup.
5. U.S. Pat. No. 6,789,321 Simms Sep. 14, 2004
   No attempt to clean mineral crystal buildup from blades or preserve edges.
6. U.S. Pat. No. 4,480,387 d'Alayer de Costemore d'Arc Nov. 6, 1984 (abandoned)
   Jets fresh water between blades dislodging debris but actually contributes to mineral buildup.
7. U.S. Pat. No. 4,027,387 Kellis Jun. 7, 1977
   Force flush fresh water around blades but again, contributes to mineral crystal buildup.
8. United States Patent Application 20130008030 Kind Code A1 Fischer; Uwe; Jan. 10, 2013
   And again, this invention addresses only electric shavers and does not address mineral buildup.

SUMMARY OF THE INVENTION

The invention is aimed at eliminating the major obstacle to shaving blade life: mineral molecule crystal formation. This method uses citric acid and common tap water but in specific ratios and steps in its preparation and use. Citric acid is a safe, naturally occurring substance in citrus fruits which most people digest and metabolize readily. It is often used in the manufacture of candy to produce a tart or sour flavoring.

DETAILED DESCRIPTION OF THE INVENTION

One cannot just rub citric acid on the blades or dip them into citric acid powder. Using a specific ratio of citric acid to water is crucial. For example, 5%-6% simply will not work. Moreover, the ratio of citric acid to common tap water varies depending on whether the water is soft or hard. A small cup or container to hold 4 ounces of water are all this necessary. The ratios are:

1. Soft water—12% ratio: One tablespoon (½ oz.) of citric acid powder to 4 ounces of water.
2. Hard water—20% ratio: Two tablespoons (1 oz.) of citric acid powder to 4 ounces of water.

Within this solution of citric acid to water, mineral molecules are unable to attach to the surface of stainless steel blades and form crystal formations. Without such crystals, blade life is governed by actual wear of the blade edge(s) during shaving. Tests have shown that blades can last five to seven times longer than without the citric acid solution. For example, some estimate the average life of a Gillette Mach 3 blade as 7 shaves. In our tests, we easily get 35 shaves, and often 49 or 50.

The user also impacts the blade life by following the procedure(s) listed in this invention. The user contributes by preparing the shaving area with warm water and shaving crème and allowing it to set on the area for 30-60 seconds before shaving. This softens the hairs thereby reducing the resistance against the blade(s). During shaving, the user flushes the blades with tap water. After shaving, the blades are given a final rinse and dipped into the solution of citric acid solution. Excessive solution is shaken off the blades and they are stored away from moisture. The factors mentioned under the section "Background of the Invention" and the extent to which the user follows recommended procedure reflects the effective range of shaves from 35 to 50 shaves.

What is claimed:

1. A method of preventing mineral crystals from forming on a razor blade used to perform shaving of hair comprising:

preparing a cleaning solution consisting of citric acid and water by mixing citric acid powder into water, wherein the weight-to-weight mixing ratio of water-to-citric-acid-powder is one weight of water to ⅛ weight citric acid powder;

performing the shaving of hair with a razor blade;

rinsing the razor blade after performing the shaving;

dipping the rinsed razor blade into the cleaning solution consisting of citric acid and water;

and shaking off cleaning solution from the cleaned blade and storing the cleaned blade away from moisture.

* * * * *